US005486070A

United States Patent [19]

Huete

[11] Patent Number: 5,486,070

[45] **Date of Patent: * Jan. 23, 1996**

[54] METHOD FOR CONDUCTING OFFSHORE WELL OPERATIONS

[75] Inventor: David A. Huete, Spring, Tex.

[73] Assignee: Shell Oil Company, Houston, Tex.

[ * ] Notice: The portion of the term of this patent subsequent to Apr. 6, 2010, has been disclaimed.

[21] Appl. No.: 316,200

[22] Filed: Sep. 30, 1994

Related U.S. Application Data

[63] Continuation of Ser. No. 35,847, Mar. 23, 1993, abandoned, which is a continuation-in-part of Ser. No. 919,630, Jul. 24, 1992, Pat. No. 5,199,821, which is a continuation of Ser. No. 624,866, Dec. 10, 1990, abandoned.

[51] Int. Cl.[6] ..... E02B 17/00

[52] U.S. Cl. ..... 405/202; 405/223.1

[58] Field of Search ..... 405/195.1, 202, 405/203, 223.1, 224, 224.2; 114/264, 265; 166/350, 353, 359, 366, 367; 175/7

[56] References Cited

U.S. PATENT DOCUMENTS

| | | | |
|---|---|---|---|
| 3,111,692 | 11/1963 | Cox | 9/8 |
| 3,255,627 | 6/1966 | Doig et al. | 73/151 |
| 3,430,601 | 3/1969 | Thompson . | |
| 3,504,740 | 4/1970 | Manning . | |
| 3,645,225 | 2/1972 | Lunde . | |
| 3,717,002 | 2/1973 | O'Brien et al. . | |
| 3,727,414 | 4/1973 | Davies . | |
| 3,798,916 | 3/1974 | Schwemmer | 61/48 |
| 3,890,916 | 6/1975 | Tummers et al. | 114/219 |
| 4,066,030 | 1/1978 | Milone . | |
| 4,156,577 | 5/1979 | McMakin . | |
| 4,185,694 | 1/1980 | Horton | 166/350 |
| 4,492,270 | 1/1985 | Horton . | |
| 4,494,738 | 1/1985 | Britton et al. | 267/140 |
| 4,497,593 | 2/1985 | Kramer | 405/212 |
| 4,633,953 | 1/1987 | LeBoeuf et al. . | |
| 4,643,614 | 2/1987 | Laursen . | |
| 4,694,771 | 9/1987 | Poldervaart et al. | 114/230 |
| 4,721,412 | 1/1988 | King et al. . | |
| 4,735,526 | 4/1988 | Kawagoe et al. . | |
| 4,740,109 | 4/1988 | Horton . | |
| 4,754,817 | 7/1988 | Goldsmith . | |

(List continued on next page.)

FOREIGN PATENT DOCUMENTS

| | | |
|---|---|---|
| 499859 | 3/1951 | Belgium . |
| WO85/01927 | 5/1985 | WIPO . |

OTHER PUBLICATIONS

"Conoco Readies Jolliet TLWP for November 1 Startup," *Ocean Industry,* pp. 17–21 (Oct. 1989).

H. I. Knecht and M. E. Nagel, "Field Experience Proves Semisubmersible Drilling Tender Concept," *Offshore,* pp. 56–57 (Sep. 1990).

Kerckhoff et al., "Minifloater: A Deepwater Production Alternative," *Ocean Industry,* pp. 147–152 (Sep. 1990).

Chitwood et al., "Semisubmersible Drilling Tender Unit," *SPE Drilling Engineering,* pp. 104–110 (Jun. 1987).

*Primary Examiner*—David H. Corbin
*Attorney, Agent, or Firm*—Mark A. Smith

[57] ABSTRACT

A method for conducting offshore well operations is disclosed in which a compliant platform is restrained out of its normal position substantially over a well pattern by adjusting a first lateral mooring system connecting the compliant platform to a first array of anchors secured to an ocean floor. An offshore drilling vessel is then positioned over a selected well site of the well pattern at a location at the surface of the water not accessible to the offshore drilling vessel with the compliant platform in its normal position by adjusting a second lateral mooring system connecting the compliant platform to a second array of anchors on the ocean floor. Well operations are then conducted through a substantially vertical riser while maintaining a clearance to prevent direct contact between the compliant platform and the offshore drilling vessel.

12 Claims, 11 Drawing Sheets

U.S. PATENT DOCUMENTS 4,784,529 11/1988 Hunter .
4,793,737 12/1988 Shotbolt ..... 405/169
4,893,965 1/1990 Jordan .
4,907,657 3/1990 Cox .
4,907,912 3/1990 Smith .
4,907,996 3/1990 Poldervaart ..... 441/3
4,913,238 4/1990 Donazcko et al. .
4,934,871 6/1990 Kazokas, Jr. .
4,966,495 10/1990 Goldman .
4,972,907 11/1990 Sellars, Jr. .
4,973,198 11/1990 Cox .
4,995,762 2/1991 Goldman .
5,159,891 11/1992 Lohr et al. ..... 114/230
5,190,411 3/1993 Huete et al. .
5,195,848 3/1993 Huete et al. .
5,199,821 4/1993 Huete et al. .
5,207,534 5/1993 Brasted et al. .

40
42
40A
48
30
60A
10
10A
26
24
12
22
50
50
60
20
54
52
46
16
28
44
44A
14
44

FIG. 2
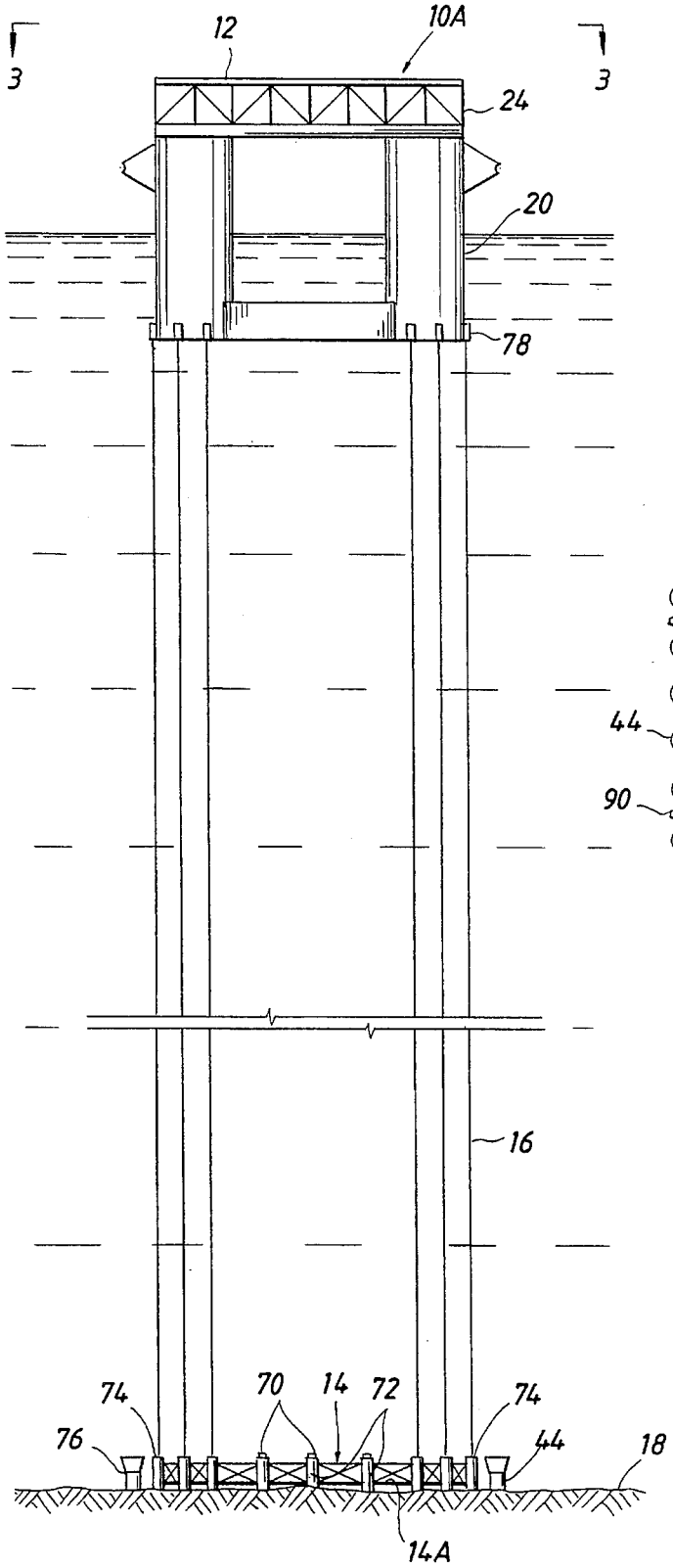
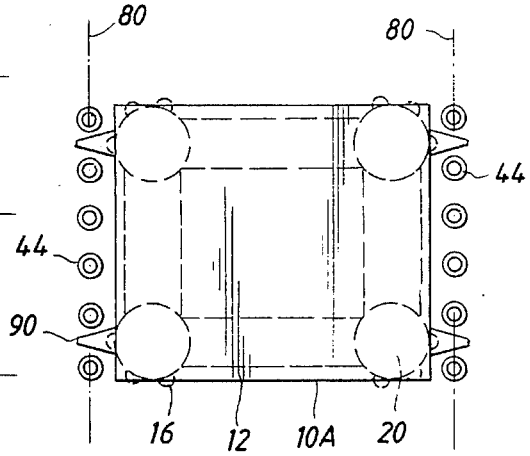
FIG. 3

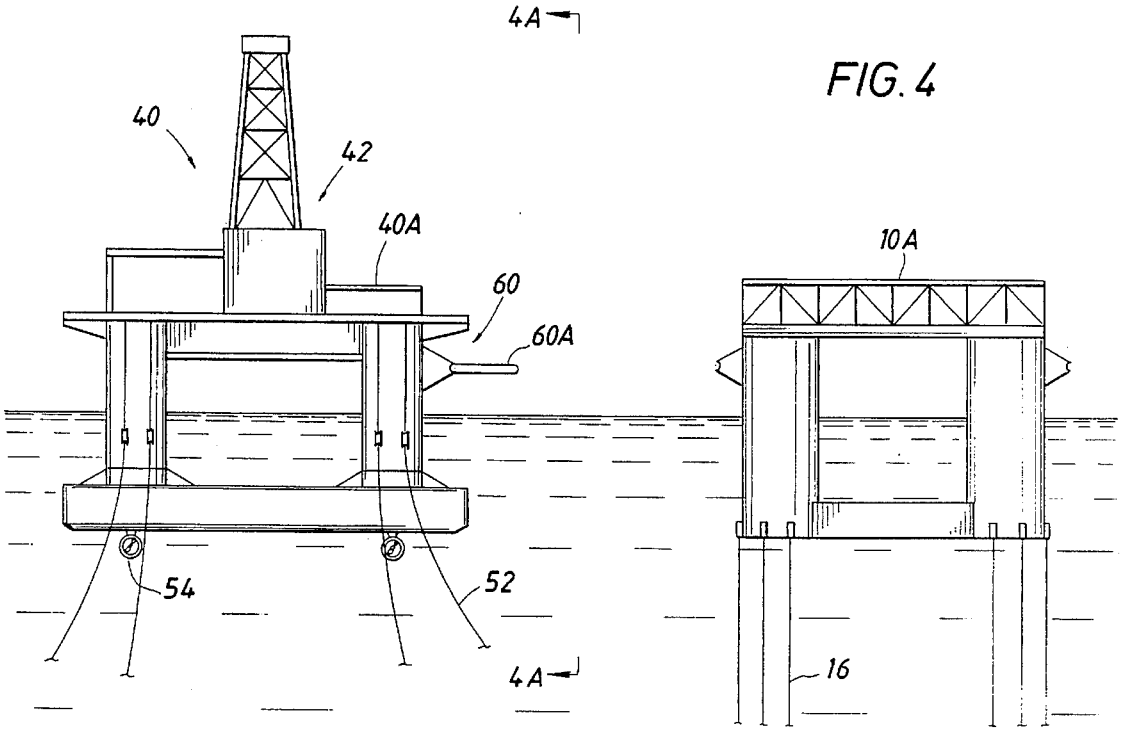
FIG. 4
FIG. 4A
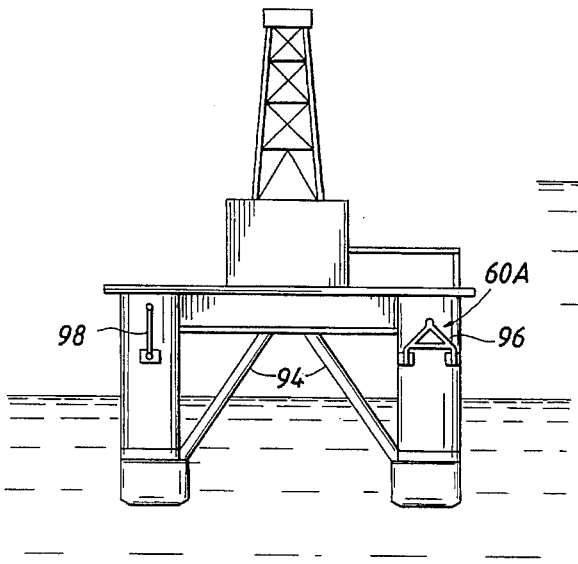
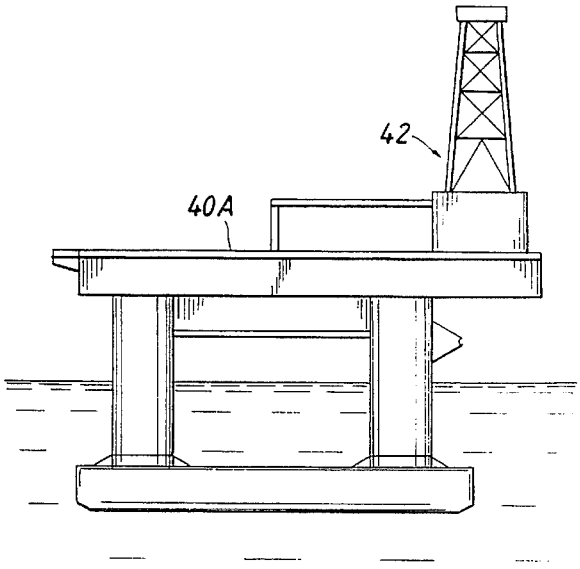
FIG. 4B

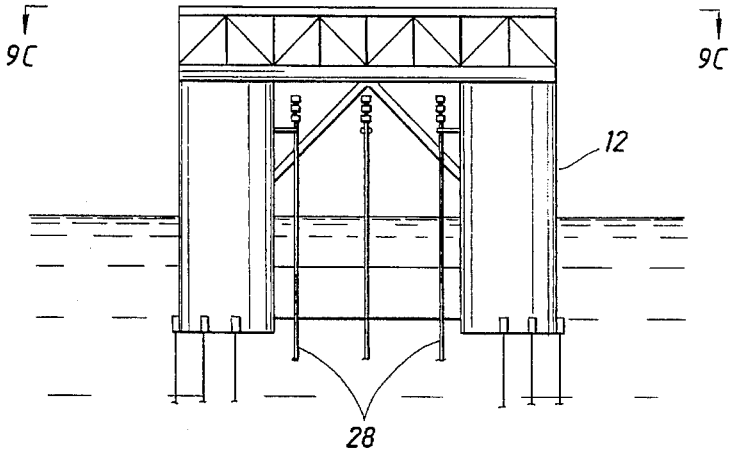
FIG.9B
FIG.9C
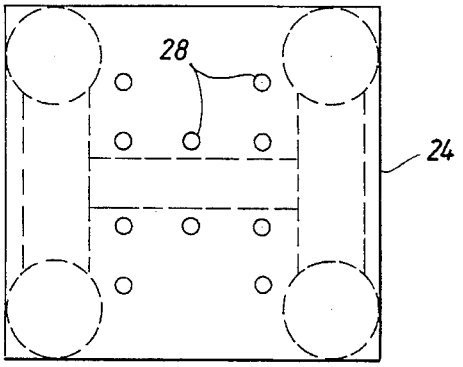
FIG.9D
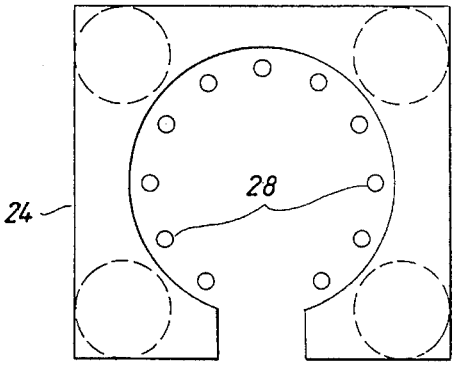
FIG.10
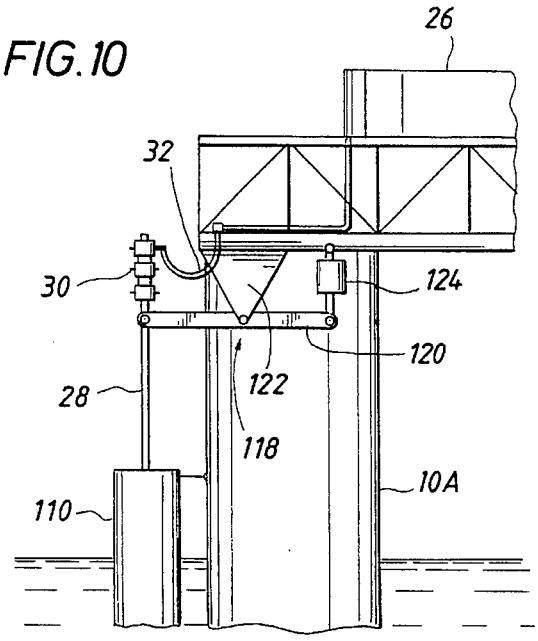
FIG.10A
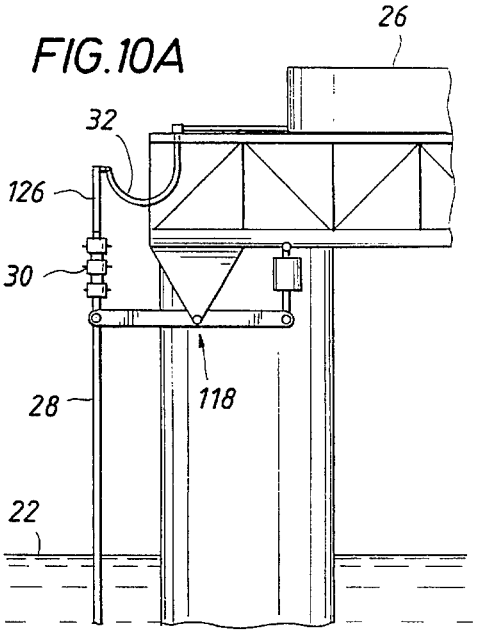

METHOD FOR CONDUCTING OFFSHORE WELL OPERATIONS

RELATED APPLICATIONS

This is a continuation of application Ser. No. 08/035,847 filed Mar. 23, 1993, now abandoned, which is a continuation-in-part of application Ser. No. 919,630, filed Jul. 24, 1992, now U.S. Pat. No. 5,199,821 which is a continuation of application Ser. No. 624,866 filed Dec. 10, 1990, now abandoned, by Huete et al for a Method for Conducting Offshore Well Operations.

BACKGROUND OF THE INVENTION

The present invention relates to a method for conducting well operations for offshore reservoirs. More particularly, the present invention relates to a method for supporting well operations for a compliant platform from an auxiliary vessel.

Traditional bottom-founded platforms having a fixed or rigid tower structures have been taken to their logical depth limits in the development of offshore oil and gas reserves. Economic considerations suggest that alternatives to this traditional technology be used in deep waters.

One alternative to fixed towers is to drill from facilities provided on surface vessels and to complete the wells at the ocean floor with subsea completions. Gathering lines connect the subsea wells to facilities usually located at the surface, either in the immediate vicinity or provided remotely in a satellite operation. However, subsea wells are relatively inaccessible at the ocean floor and this fundamental problem is exacerbated by the rigors of the maintenance-intensive subsea environment. The result is complex, costly maintenance operations.

Deepwater wells can be provided with surface completions on specialized structures more suitable for deepwater applications. Designs have been developed for various configurations of tension leg, compliant tower, and articulated tower platforms as well as floating production systems which can provide drilling and production facilities in deep water at costs less than those of traditional fixed platforms. However, the cost of deepwater platforms increases with the extent of the drilling operations that are to be conducted from the platform. This substantially increases the load on the platform for full drilling capabilities, thereby requiring a substantially larger structure. Further, primary drilling operations to develop a dispersed reservoir with extended reach techniques from a central location can spread the drilling operations over many years. Subsequent well workover operations may tie the drilling rig to the platform many years thereafter even though primary drilling is complete. Both aspects represent economic inefficiencies. In the first instance, drilling such extended reach wells, one well at a time, delays production, thereby adversely affecting the rate of return of the substantial capital expenditures necessary to provide such a deepwater structure. Further, after the wells have been drilled, the rig represents a very substantial asset which cannot otherwise be efficiently used and has similarly permanently committed the prospect to the larger structure, thereby affecting the cost of the platform as well.

Alternatively, the wells can be predrilled from a drill ship or other floating facility, killed or otherwise secured, and completed from a scaled-down "completion" rig carried on a production platform such as a tension leg well platform ("TLWP") installed at the site later. This reduces the load on the permanent facilities and therefore permits a smaller platform, but prevents production from any well until all the wells have been drilled and thereby substantially defers revenue from the development. Further, this scheme does not allow the flexibility to permit additional or replacement drilling once the platform has been installed.

Efficient development of deepwater hydrocarbon reserves must overcome these deficiencies and provide a method for conducting well operations which facilitates lower capital outlays, faster return on investment, more efficient reservoir management for larger reservoirs, and enhanced profitability for reservoirs that are otherwise marginal.

SUMMARY OF THE INVENTION

It is an object of the present invention to provide a method of conducting well operations which facilitate the use of minimal compliant platforms in the development of offshore oil and gas wells, especially in deep water.

It is a further object of the present invention to provide a method for drilling oil and gas wells in deep water in a manner affording surface completion without dedicated drilling facilities which will often sit idle during the production phase of the development.

Finally, it is an object of the present invention to provide a method for drilling for additional development wells and to conduct maintenance work on existing wells supported on a compliant platform using facilities on an auxiliary vessel.

Toward the fulfillment of these and other objects, a method for conducting offshore well operations is provided which comprises restraining a compliant platform out of its normal position substantially over a well pattern by adjusting a first lateral mooring system connecting the compliant platform to a first array of anchors secured to an ocean floor and positioning an offshore drilling vessel over a selected well site of the well pattern at a location at the surface of the water not accessible to the offshore drilling vessel with the compliant platform in its normal position by adjusting a second lateral mooring system connecting the compliant platform to a second array of anchors on the ocean floor. Well operations are then conducted through a substantially vertical riser while maintaining a clearance to prevent direct contact between the -compliant platform and the offshore drilling vessel by relative adjustments of the first and second sets of lateral mooring lines, respectively.

Thus, the method and system of the present invention facilitates well operations support with an auxiliary vessel for surface accessible completions hung on a deepwater compliant platform. This permits the use of a compliant platform which does not have to be scaled to accommodate the weight of a major drilling rig and permits well operation facilities supplied by the auxiliary vessel to relocate when those facilities are not needed at the platform.

BRIEF DESCRIPTION OF THE DRAWINGS

The brief description above, as well as further objects, features and advantages of the present invention will be more fully appreciated by reference to the following detailed description of the preferred embodiments which should be read in conjunction with the accompanying drawings in which:

FIG. 2 is a side elevation view of a TLWJ suitable for use in the practice of the present invention;

FIG. 3 is a top plan view of the TLWJ of FIG. 2 taken along line 3—3 of FIG. 2;

FIG. 4 is a side elevation view of a semisubmersible vessel approaching a compliant platform in accordance with the present invention;

FIG. 4A is a front elevation view of the semisubmersible vessel of FIG. 4 taken along the line 4A—4A;

FIG. 4B is a side elevation view of an alternate embodiment of a semisubmersible vessel in which the drilling facilities are positioned on a cantilevered section of the deck;

FIG. 9B is a side elevation view of an alternate embodiment of a compliant platform having laterally accessible means for receiving production risers;

FIG. 9C is a top plan view of the compliant platform of FIG. 9B taken along line 9C—9C in FIG. 9B;

FIG. 9D is an overhead plan view of an alternate embodiment of a compliant platform having laterally accessible riser receiving means;

FIG. 10 is a side elevation view of a production riser being secured to the compliant platform;

FIG. 10A is a side elevation view of a production riser being brought into communication with facilities supported by the compliant platform;

DETAILED DESCRIPTION OF PREFERRED EMBODIMENTS

Figure 1:
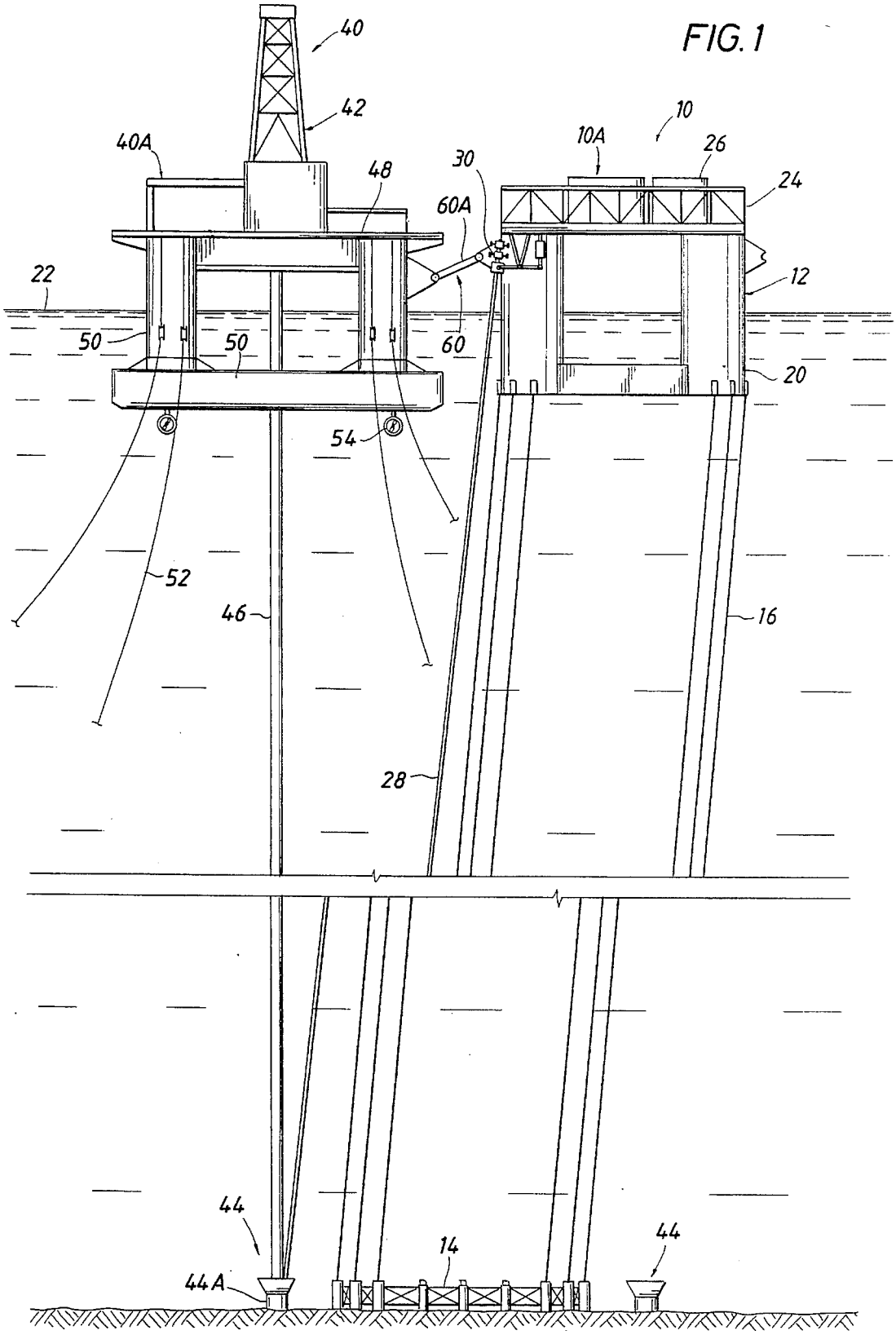
FIG. 1 is a side elevation view of a semisubmersible vessel conducting well operations in accordance with the present invention adjacent a tension leg well jacket ("TLWJ")

FIG. 1 is a side elevation view of well operations practiced in accordance with the present invention with compliant platform 10 docked to offshore drilling vessel 40, here a semisubmersible vessel 40A, for conducting such operations.

In the illustrated embodiment, compliant platform 10 is provided by a tension leg well jacket ("TLWJ") 10A which has a floating superstructure 12 secured to a foundation 14 with a plurality of tendons or tension legs 16 which draw buoyant hull 20 of superstructure 12 below its free-floating draft at ocean surface 22. Hull 20 supports a deck 24 which carries processing facilities 26.

Semisubmersible vessel 40A is illustrated conducting drilling operations with derrick and related drilling facilities 42 supported on deck 48 which is in turn supported by pontoons, columns or other buoyant members 50. The derrick of the semisubmersible vessel is positioned over one of the well sites 44, here at well site 44A, using a catenary mooring system 52 or dynamic positioning thrusters 54 and drilling operations are conducted through a drilling riser 46. A production riser 28 of a previously drilled well is supported by TLWJ 10A with the valve assembly of the surface completion or Christmas tree 30 supported above the ocean's surface.

Offshore drilling vessel 40 interfaces with compliant platform 10 through a restraining system 60, here provided by a means 60A for docking the semisubmersible vessel to the tension leg well jacket. The preferred restraining system is discussed in further detail hereinbelow.

Figure 1A:
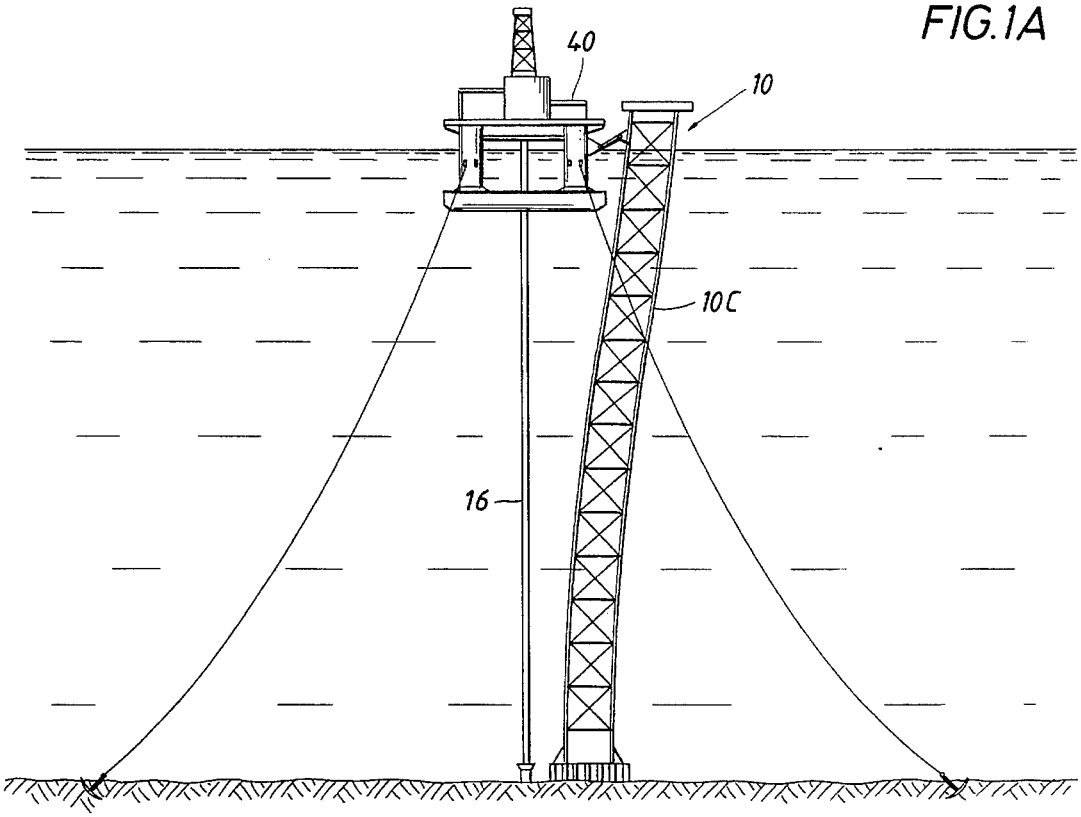
FIG. 1A is a side elevation view of an alternate embodiment of the practice of the present invention in which a semisubmersible vessel is conducting drilling operations adjacent a compliant tower platform.
Figure 1B:
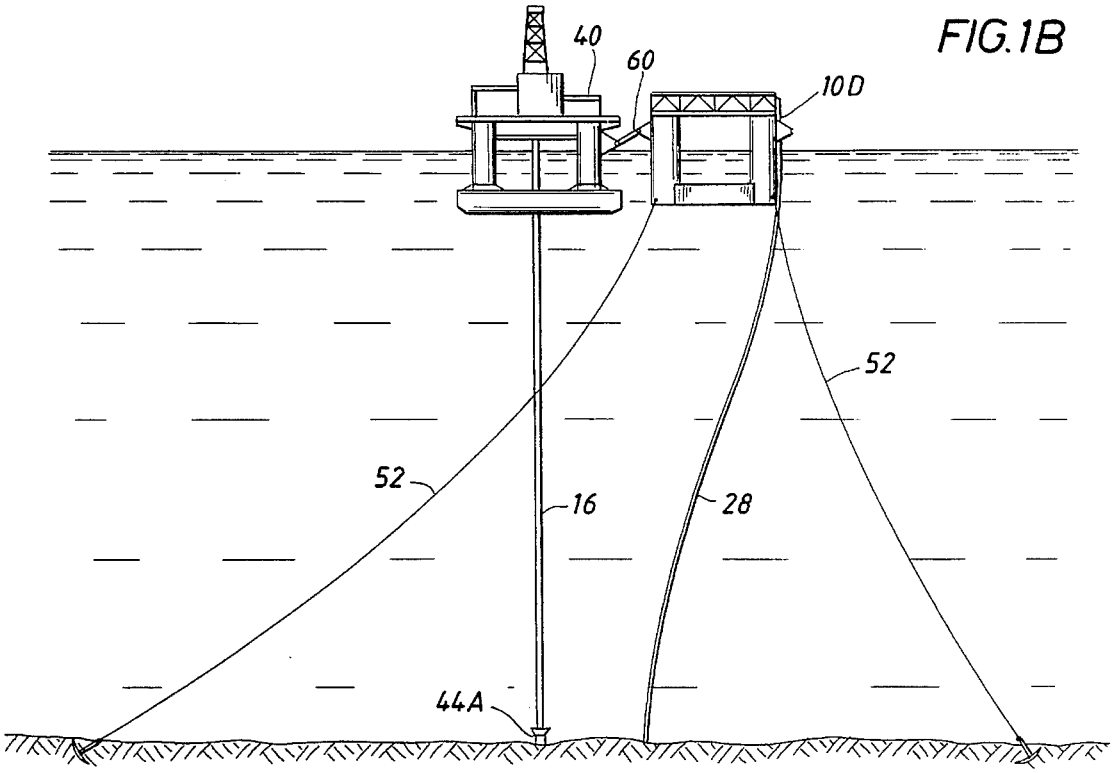
FIG. 1B is a side elevation view of an alternate embodiment of the practice of the present invention in which a semisubmersible vessel is conducting drilling operations adjacent a floating production system ("FPS")

A full range of different compliant platforms can be adapted for use in the practice of the present invention and FIGS. 1A and 1B represent a sample of the breadth of practicing this invention. FIG. 1A is an alternate embodiment of the practice of the present invention in which compliant platform 10 is provided by a compliant tower 10C which is assisted by drilling from offshore drilling vessel 40. FIG. 1B is an alternative embodiment of the practice of the present invention in which an offshore drilling vessel 40 is connected through a restraining system 60 to a floating production system 10D which has its own positioning system with catenary mooring lines 52. In this embodiment the floating production system is positioned so that the offshore drilling vessel connected to it will be brought into place over a selected well site 44A for drilling operations.

Figure 1C:
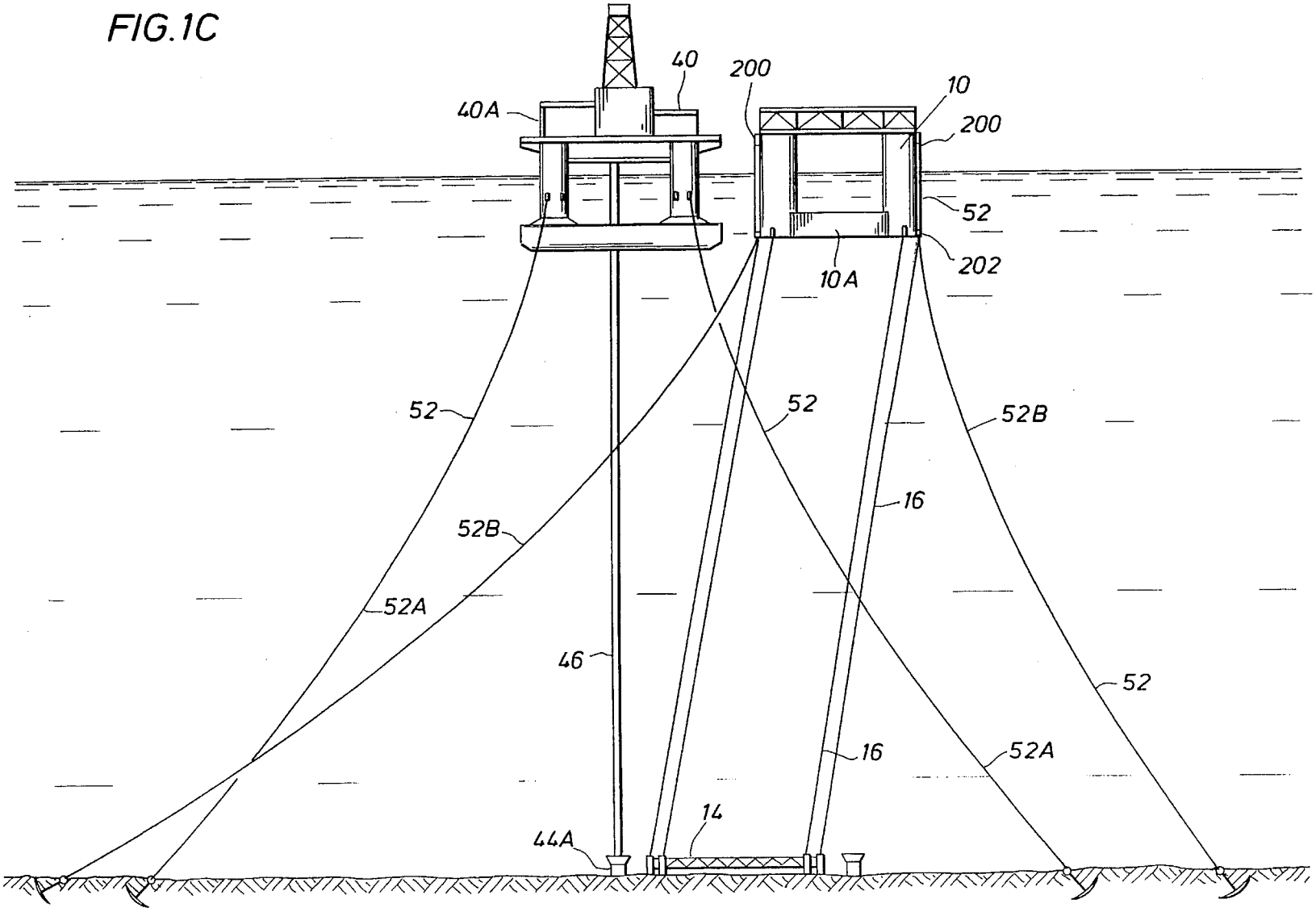
FIG. 1C is a side elevation view of an alternate embodiment of the practice of the present invention in which a semisubmersible vessel is conducting well operations adjacent a tension leg well jacket in accordance with the present invention.

In the embodiment of FIG. 1C, both offshore drilling vessel 40 and compliant platform 10 are positioned in direct reference to the ocean floor. In the illustrated practice of this embodiment, the compliant platform, TLWJ 10A, is positioned with a first lateral mooring system 52B and the offshore drilling vessel, semisubmersible vessel 40A is provided with a second lateral mooring system 52A, each anchored to the ocean floor. These first and second lateral mooring systems cooperate to define the relative positions of the TLWJ and the semisubmersible vessel, respectively, in relation to the ocean floor. This serves to indirectly define the position of the semisubmersible vessel with respect to the TLWJ and affords the opportunity to prevent loading therebetween by maintaining a clearance and no direct docking or connection between the TLWJ and the semisubmersible.

TLWJ 10A is biased aside by use of first lateral mooring system 52B. In one embodiment, linear winches 200 draw in and play out mooring lines 52 around a chock 202 at the base of the TLWJ hull to reposition the TLWJ within the anchor spread of TLWJ 10A. Alternatively, an anchor handling vessel may be used to set tension in the mooring lines so as to position the TLWJ. It is also preferred to provide a quick release mechanism between the TLWJ and the first lateral mooring system. Additional details of line handling techniques are set forth in U.S. patent application Ser. No. 08/024,582 filed by Huete et al on Mar. 1, 1993 for a Compliant Platform with Parasite Mooring through Auxiliary Vessel, which application is hereby incorporated by reference and made a part hereof.

Thus, this embodiment prevents direct loading between the TLWJ and the semisubmersible vessel without complicated hardware and with a minimum of modifications to semisubmersible vessels as currently available.

Two disadvantages of this embodiment is that an additional lateral mooring system is required and that a safe clearance between the semisubmersible vessel and the TLWJ may require a greater offset than required for alignment of well operation equipment of a directly connected semisubmersible vessel.

Well operations in accordance with the present invention provide well operations facilities to a compliant platform from an auxiliary vessel. A "compliant" platform is any offshore surface facility designed to "give" in a controlled manner with environmental loading rather than rigidly resist such force. This basic design precept distinguishes the fixed or rigid bottom-founded towers which require vast amounts of structural materials for extension into deep water. Many basic configurations of compliant platforms have been proposed including articulated towers, compliant towers, compliant piled towers, TLP's, etc., a sampling of which are illustrated in the FIG. 1 series discussed above. However, any basic configuration which is compliant, favorably economically sensitive to load reductions, and adapted to receive laterally transferred production risers is well suited for use in the practice of the present invention. FIGS. 4 through 9 illustrate the practice of the present invention using the tension leg well jacket ("TLWJ") of FIGS. 2 and 3, but those skilled in the art and familiar with the teachings of this application could apply this practice to any other basic compliant platform configuration.

FIGS. 2 and 3 illustrate a TLP configuration which is especially suited for the practice of the method of the present invention. This compliant platform is a tension leg well jacket ("TLWJ") 10A which comprises a minimal TLP without drilling capabilities, and, at most, modest workover capabilities. The TLWJ is designed to exteriorly receive and secure production risers passed from the offshore drilling vessel (not shown here). FIG. 2 is a side elevation view of the TLWJ and FIG. 3 is an overhead view. These figures illustrate the same TLWJ pictured during drilling operations in FIG. 1.

Installation of TLWJ 10A begins by placing foundation 14, here supplied by unitary template 14A. The foundation is then secured to ocean floor 18. In the illustration, a plurality of piles 70 are driven into the ocean floor through pile sleeves 72 of the foundation and the piles are then secured to the pile sleeves with grouting or swaging operations. Other well known means for anchoring the foundation to the ocean floor may also be suitable. The foundation provides a means 74 for connecting tendons 16 and may include well guides 76 which are placed at well sites 44 adjacent the foundation. In the illustration, the well guides are placed independently and are not connected to the template. In some instances it is desirable to predrill some of the wells.

Superstructure 12 comprising buoyant hull 20 and deck 24 is towed to location and ballasted down. Tendons 16 are installed between means 74 for connecting the tendons to the foundation and means 78 for connecting the tendons 16 to floating superstructure 12. The tendons are initially tensioned during installation and deballasting of buoyant hull 20 further tensions the tendons to provide additional excess buoyancy to the TLWJ as necessary to produce the desired behavior under all loading conditions.

Desired well sites 44 are aligned in well lines 80 adjacent TLWJ 10A as best depicted in FIG. 3. Provisions are discussed below which facilitate laterally receiving and securing production risers transferred from an offshore drilling vessel. Another feature of the illustrated TLWJ is a plurality of docking supports 90, the purpose and function of which will become apparent in the discussion of the docking procedures illustrated in FIGS. 5 and 6.

FIG. 4 illustrates deployment of offshore drilling vessel 40 adjacent installed TLWJ 10A. The offshore drilling vessel is a floating structure which carries a derrick, drawworks and related drilling facilities 42. Further, the term "offshore drilling vessel" is intended to cover any transportable, floating facilities of an auxiliary vessel capable of supporting well operations such as drilling, completion, workover, well repair or abandonment. Preferably these facilities are provided in a substantially open design adapted for stability in deepwater drilling applications. Semisubmersible vessels represent a class of vessels well suited to this application and have been used throughout to generally illustrate the practice of the present invention.

Semisubmersible vessel 40A in FIG. 4 is maneuverable by either catenary mooring lines 52 or dynamic positioning thrusters 54. For purposes of this embodiment of the practice, the catenary mooring lines are deployed and anchored in a spread about the semisubmersible vessel which overlaps the position of the TLWJ. Semisubmersible vessel 40A can then be maneuvered with respect to TLWJ 10A by playing out and retrieving selected catenary mooring lines 52.

FIG. 4A illustrates adaptation of conventional semisubmersible vessels to facilitate practice of the present invention. This Figure shows the end of semisubmersible vessel 40A of FIG. 4 which will approach the TLWJ. Certain conventional semisubmersible vessel configurations can be "opened up" to provide lateral access from beneath the semisubmersible vessel by removing a horizontal brace conventionally placed between the pontoons and reinforcing the remaining structure, such as with diagonal struts 94. If desired, provisions may be undertaken to allow the horizontal brace to be selectively removed for riser transfer operations, yet provide stability in place during transport and, perhaps, during drilling operations.

Another modification of conventional semisubmersible vessels necessary to best facilitate the practice of the invention is installation of a restraining system 60, which in this embodiment is provided by a means 60A for docking which comprises a hinged docking frame 96 and a hinged docking strut 98.

FIG. 4B illustrates an alternative to modifying a conventional semisubmersible vessel for practice with the present invention. A special purpose semisubmersible vessel having a cantilevered deck with an end well bay providing a derrick and attendant drilling facilities thereon will allow well operations with less displacement of the compliant tower than required for use of the center bay facilities on the semisubmersible vessel of FIGS. 4 and 4A.

Figure 5:
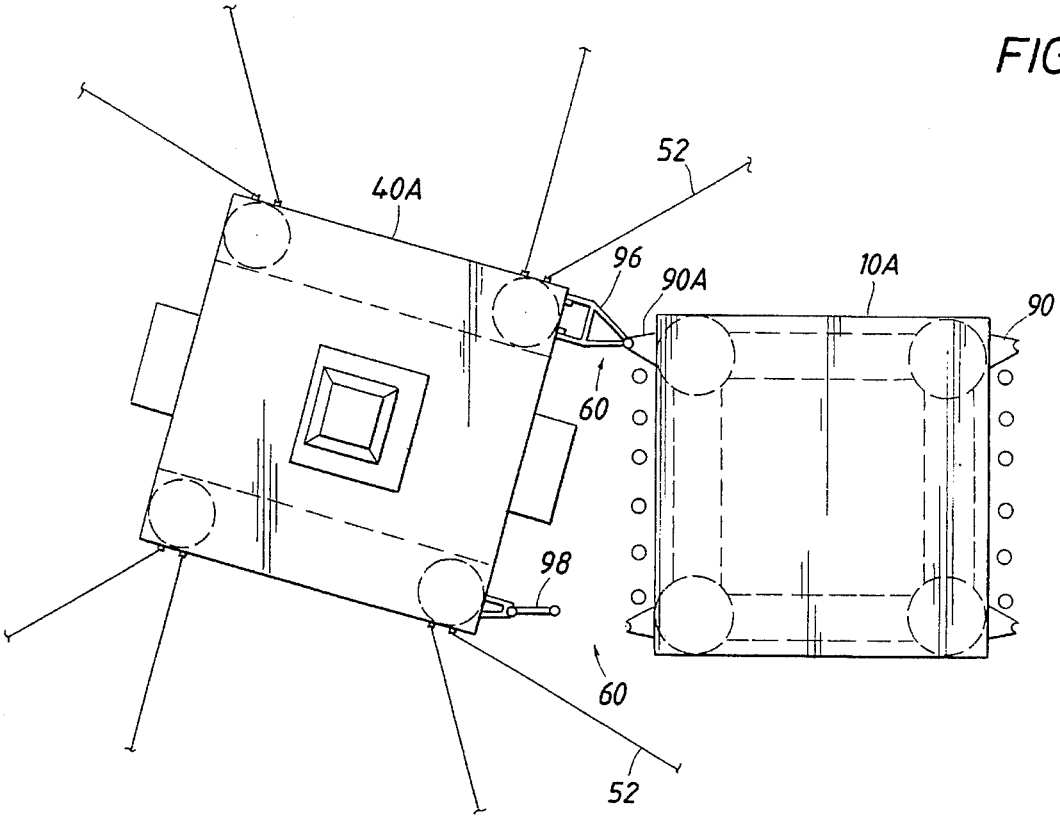
FIG. 5 is an overhead plan view of a semisubmersible vessel beginning docking operations with a compliant platform in accordance with an embodiment of the practice of the present invention.
Figure 6:
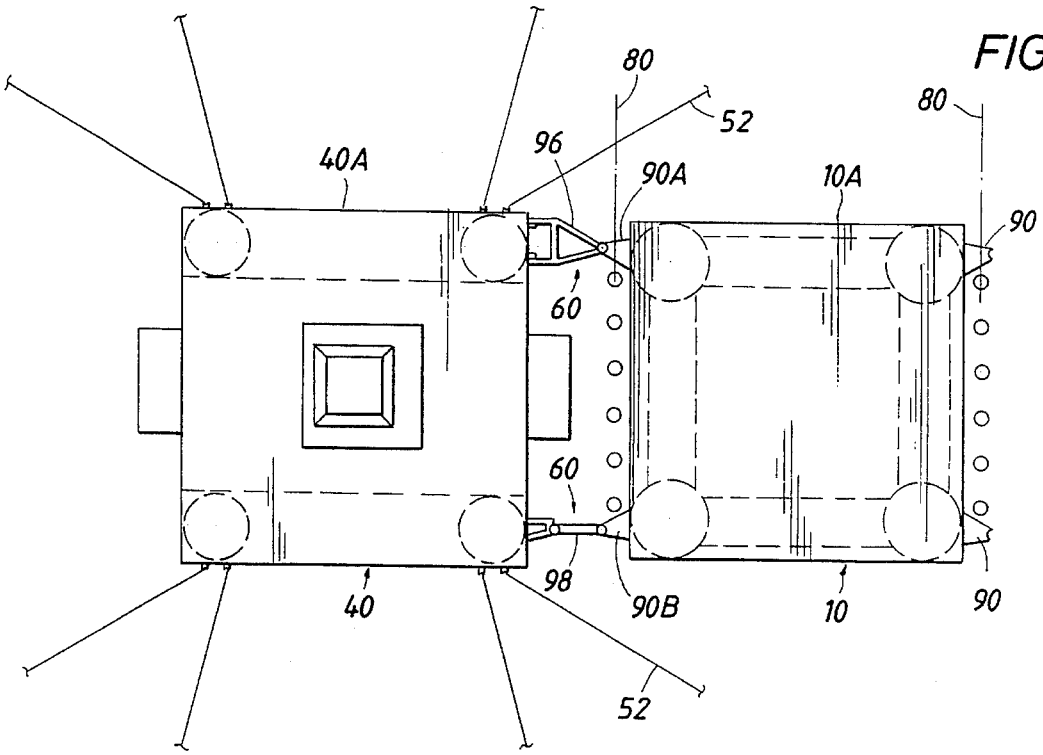
FIG. 6 is a top plan view of a semisubmersible vessel completing docking operations with a compliant platform in accordance with the practice of an embodiment of the present invention.

FIG. 5 illustrates the initiation of docking procedures between semisubmersible vessel 40A and TLWJ 10A. Catenary mooring lines 52 are adjusted to bring lowered docking frame member 96 adjacent docking support 90A on the TLWJ and a connection is made, e.g. by inserting a pin. The docking frame than secures the semisubmersible vessel to the TLWJ to produce a 2-degree of freedom restraint.

Catenary mooring lines are further adjusted to rotate the semisubmersible vessel 40A and bring lowered docking strut 98 into the position to connect with docking support 90B. See FIG. 6. Similarly, this connection can be secured with a pin or a multi-axis rotation connection and will provide a 1-degree of freedom restraint. This fully secures the offshore drilling vessel 40 to compliant platform 10 such that wave action will not cause collisions between the two.

Figure 7:
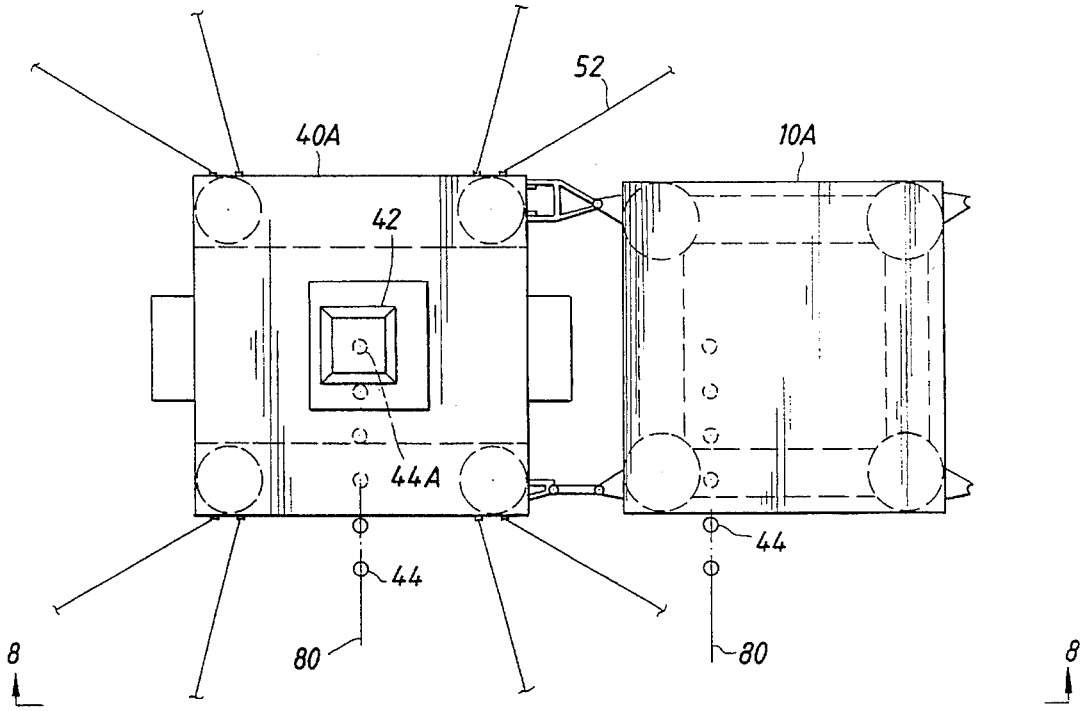
FIG. 7 is a top plan view of a semisubmersible vessel docked to a compliant platform and taking position for drilling operations over a selected well site in accordance with the practice of an embodiment of the present invention.
Figure 8:
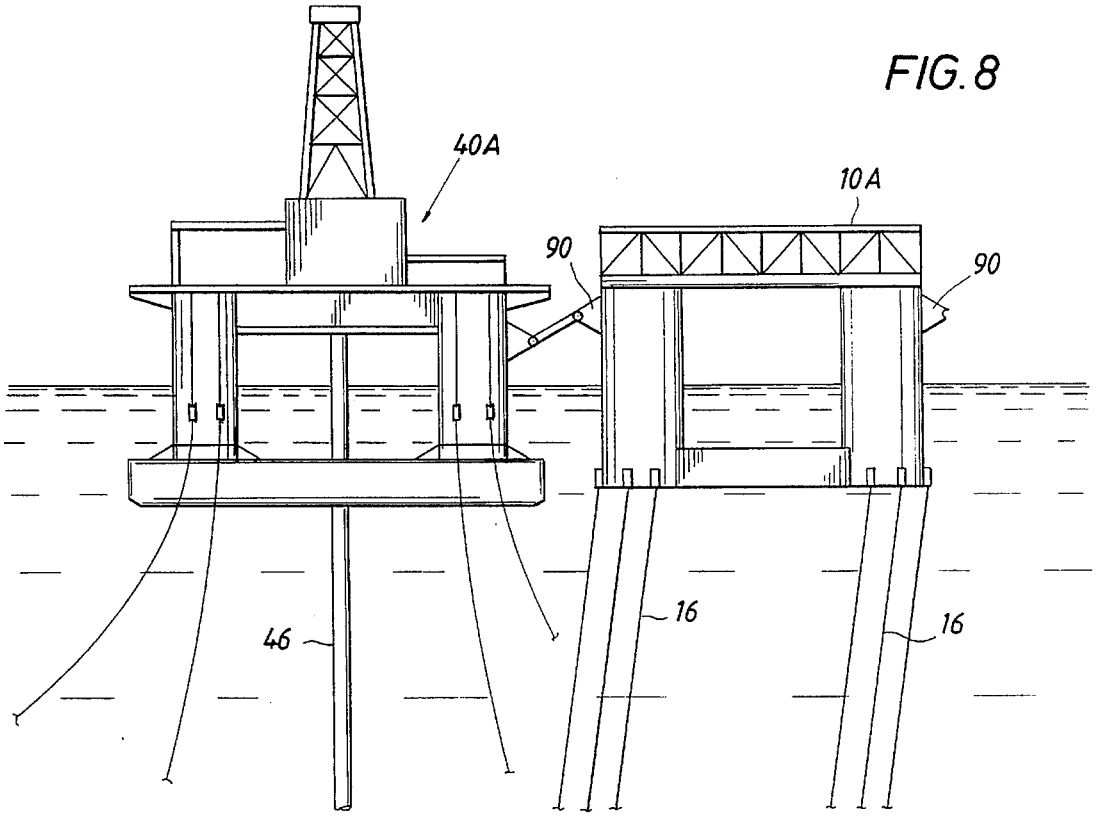
FIG. 8 is a side elevation view of a semisubmersible vessel docked with a compliant platform and conducting drilling operations in accordance with the practice of an embodiment of the present invention.

Docking also facilitates moving TLWJ 10A with positioning systems carried on semisubmersible vessel 40A. Compare FIG. 6 in which TLWJ 10A is normally centered between well lines 80 at the periphery of the TLWJ with FIG. 7 wherein the catenary mooring lines 52 have been adjusted to bias TLWJ out of alignment with its nominal position and to bring the derrick and related drilling facilities 42 into alignment with a selected well site 44A. The semisubmersible vessel of FIG. 7 is in position to initiate drilling or other well operations through a drilling riser 46 as further illustrated in FIG. 8. The drilling operations are best undertaken in substantially vertical drilling risers and the ability to shift compliant platform 10 slightly out of alignment with its nominal resting position in order to place the derrick over a selected well site substantially enhances drilling efficiency and reduces equipment wear. This ability also allows continuing drilling operations once the TLWJ is in place and thereby allows production to come onstream as soon as wells are completed, even as the drilling program proceeds.

FIGS. 1A and 1B demonstrate practice of the present invention with alternate embodiments of the compliant platform as provided by compliant tower 10C and floating production system 10D, respectively. There is also the reversal of the use of catenary mooring lines 52 with respect to the floating production system in FIG. 1B in which the floating production system is adjusted to place offshore drilling vessel 40 substantially vertically over a selected well site 44A.

Alternatively, the TLWJ may be provided with thrusters or a lateral mooring system of its own to serve as restraining system 60 in lieu of the presently preferred means 60A for docking. In this latter embodiment, the restraining system of the TLWJ would pull and hold the TLWJ sufficiently clear for an offshore drilling vessel to conduct well operations adjacent the foundation of the TLWJ without danger of collision and without docking thereto.

After drilling or other well operations are performed, drilling riser 46 is replaced with a lighter weight production riser 28 and the drilling facilities on offshore drilling vessel 40 are used through the production riser to complete the well. See FIG. 9. Alternatively, the same riser which serves as a drilling riser during well operations can serve as the production riser in production operations. After completion of the well and installation of a surface Christmas tree 30, a temporary buoyancy module 110 is installed about the production riser and the production riser is passed or transferred to compliant platform 10, here TLWJ 10A.

Figure 9:
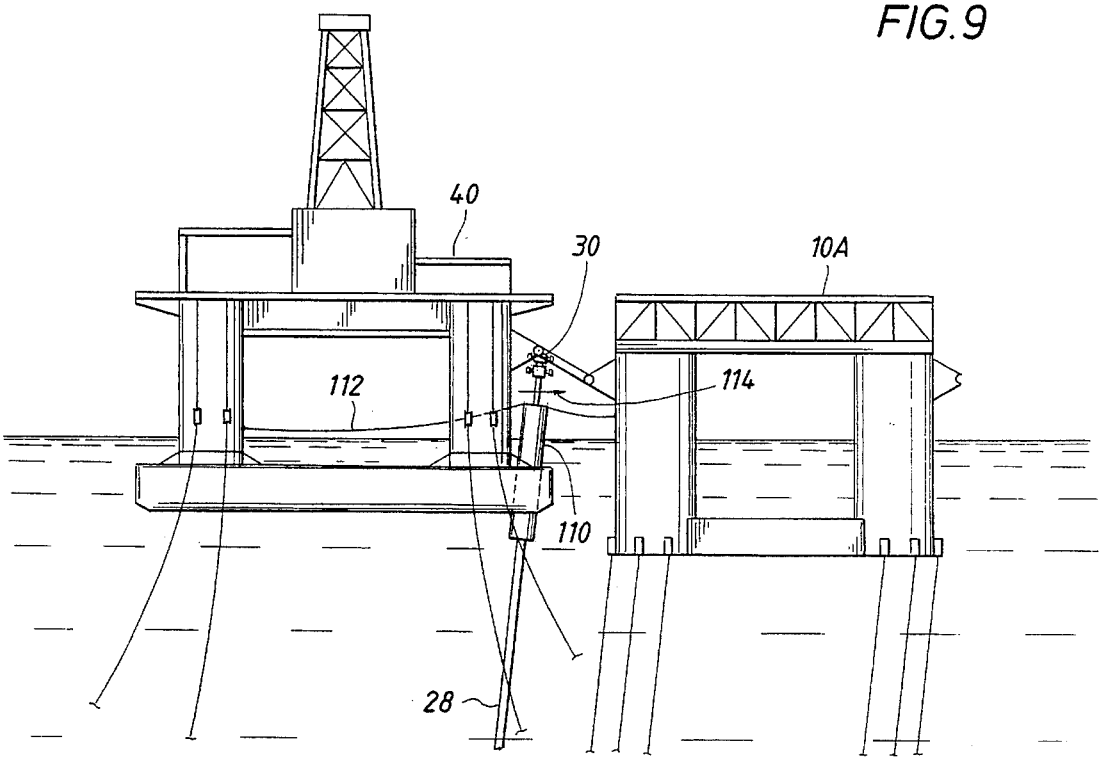
FIG. 9 is a side elevation view of a semisubmersible platform transferring a riser to a compliant platform in accordance with the practice of the present invention.
Figure 9A:
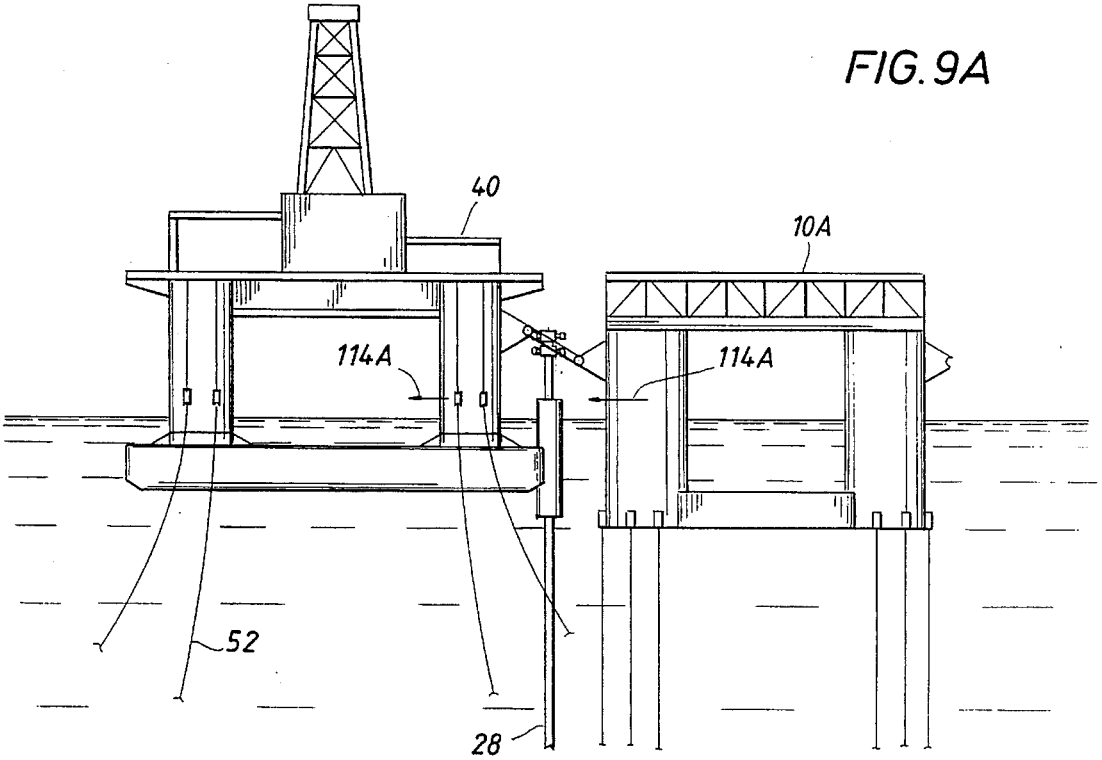
FIG. 9A is a side elevation view of an alternate embodiment of a semisubmersible vessel transferring a riser to a compliant platform in accordance with the practice of the present invention.

FIGS. 9 and 9A illustrate alternative methods for transferring the production riser. In FIG. 9, guylines 112 are used to draw production riser 28 to TLWJ 10A and arrow 114 illustrates this transfer. By contrast, FIG. 9A illustrates the use of the natural righting ability of temporary buoyancy module 110 to maintain production riser 28 in place while catenary mooring lines 52 are adjusted to bring TLWJ 10A into position to receive the substantially stationary production riser 28. Note arrows 114A. The presently preferred method for undertaking this transfer is a combination of both the embodiments of FIG. 9 and 9A.

FIGS. 9B, 9C and 9D show alternate embodiments for superstructure 12 of a tension leg platform which facilitate lateral transfer of the production riser. FIG. 9B and 9C illustrate one embodiment in which an H-shaped superstructure and a high deck permit placement of the production risers 28 underneath deck 24 in a position more sheltered than the peripheral placement in the embodiment of FIGS. 9 and 9A. FIG. 9D shows a "keyhole" deck which similarly allows laterally transferred production risers to be secured to the compliant platform at a sheltered position.

Thus, the method of the present invention facilitates well operations in support of compliant platforms. More particularly, it provides a method for primary drilling, infill drilling, completion of predrilled wells, workover operations and any other major well operations which, in the prior art, would have required considerable, dedicated facilities to be provided on the compliant platform.

Well operations are complete after the riser is secured to the compliant platform, although the use of the present invention is best understood in relation to full deployment of the compliant platform in the development of offshore hydrocarbon reserves. Thus, a discussion of FIGS. 10–15 will help those having ordinary skill in the art to best appreciate the benefits of the present invention.

Comparing FIGS. 10 and 10A, it may be desired to remove buoyancy device or module 110 from production riser 28 once the production riser has been secured to the compliant platform. Alternatively, buoyancy module 110 may be left on riser 28 to afford a measure of protection to the riser from surface hazards such as boat traffic or floating debris. This will also contribute substantially to the vertical support of the riser, thereby further reducing the required displacement of the TLWJ.

FIG. 10A illustrates the step of establishing communication between the surface completion of the production riser and the facilities on the compliant platform.

Preferably, the transferred production riser is secured to TLWJ 10A through a dynamic tensioning device 118. See FIG. 10. The dynamic tensioning device serves to maintain a substantially constant tension on production riser 28 despite motion of compliant platform 10 due to environmental forces. Many types of dynamic tensioning devices are suitable, including pneumatic, hydraulic, elastomeric, or combinations thereof. In some instances, such as where the risers are approximately the same length as the tendons, dynamic tensioning devices may not be necessary. The tensioning device illustrated in FIG. 10 is well suited to receiving the laterally transferred production riser and includes a lever or rocker arm 120 connected to TLWJ 10A through fulcrum 122. A pressure charged elastomeric strut 124 provides the compensating force and is connected to one end of lever arm 120 and the production riser is attached at the other end of rocker arm 120 with a pivotal load connection. In the preferred embodiment, communication is established between the surface completion or Christmas tree 30 which is affixed atop the production riser 28 with a flexible flowline 32. Flowline 32 feeds the production fluids from production riser 28 to processing facilities 26. The processing facilities may be as simple as manifolds collecting the production fluids from a number of wells and directing them to an export riser, or may include separation equipment for removing liquid products from gas produced or other various treatment systems to initially process the produced fluids into components more suitable for transport.

Another option illustrated in FIG. 10A is the use of a tree extension 126 which can elevate flexible flowline 32 above the wave zone adjacent ocean surface 22 in the event the semisubmersible configuration requires a low mounted Christmas tree 30 for the transfer operations.

Figure 11:
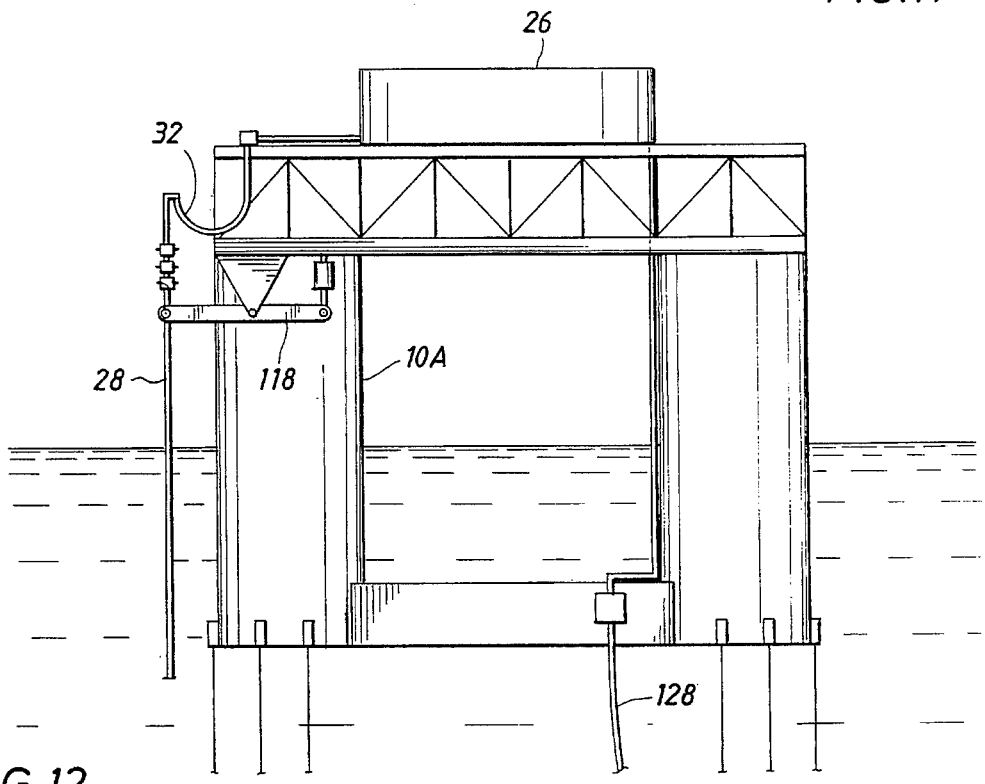
FIG. 11 is a side elevation view of a tension leg well jacket in the production mode.

FIG. 11 illustrates TLWJ 10A in the production mode in which a plurality of production risers 28 are supported by TLWJ 10A through dynamic tensioning devices 118 and in which fluids produced from the well are carried up the production riser and to facilities 26 through flexible flowlines 32 for combination and/or treatment before export through a catenary export riser 128 to transport facilities such as a subsea pipeline (not shown).

Figure 12:
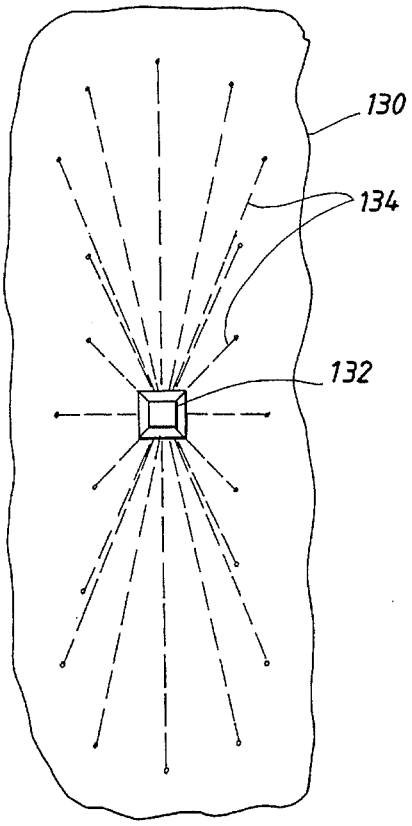
FIG. 12 (PRIOR ART)
FIG. 12 is an overhead view schematically illustrating the use in the prior art of central facilities to develop extended deepwater reservoirs.
Figure 13:
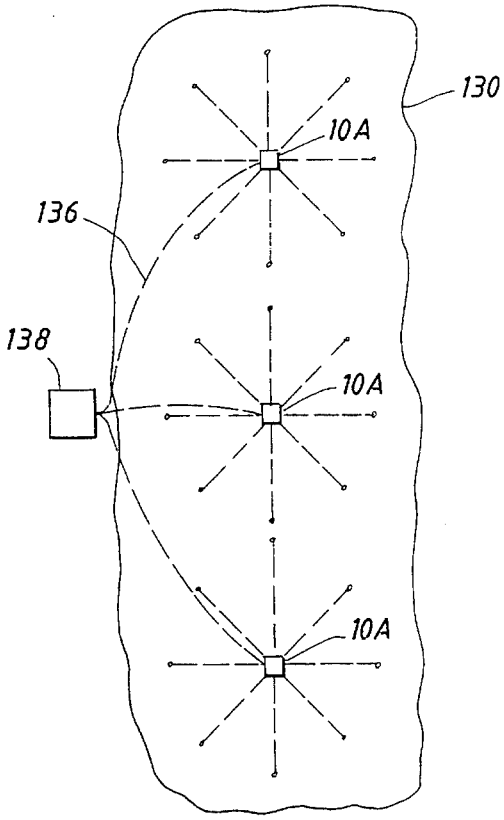
FIG. 13 is an overhead view schematically illustrating the use of satellite TLWJ's as facilitated by the present invention.

FIGS. 12 and 13 demonstrate some of the potential advantages of practicing the present invention. FIG. 12 is a schematic diagram of a deepwater reservoir 130 developed conventionally such as through a central TLP 132. The extended reach drilling operations from the TLP must project horizontally a great distance in order to reach the far portions of the reservoir. The completed wells are designated by broken lines 134. These wells are drilled, one well at a time, over a number of years in order to establish the pattern illustrated. Production from later wells must be deferred until they can be reached. Further, the great horizontal reach defers completion of each well while, in effect, a lengthy underground pipeline is built for each well as the wellbore is cased and drilling proceeds. The large TLP structure necessary to support the drilling operations requires a very promising field and a great number of wells to prove economically attractive and, once completed, supports an idle drilling rig substantially through the remaining life of the field.

By contrast, the same deepwater reservoir 130 is illustrated in FIG. 13 in which satellite TLWJs 10A combine with a tension leg production facility 138 to provide a more rapid, more thorough, and more economical development of reservoir 130. FIGS. 12 and 13 depict approximately the same number of total wells, at approximately the same location. However, in FIG. 13, satellite TLWJs 10A are used with less extensive extended reach drilling to efficiently collect production fluids and, with only the most minimal processing, transfer the produced hydrocarbons to processing facility 138 through pipelines 136. The TLP with production facilities 138 may itself present exteriorly receiving well bays that may support additional wells 134 drilled with external facilities. In this illustration, three separate semisubmersible vessels may simultaneously conduct well operations to substantially shorten the completion time. Further, this system will afford the opportunity to have revenue streams from those wells that have been completed while additional wells are being drilled. The minimal tension leg well jacket, and process facilities on a central TLP that does not have to support drilling equipment, can be installed at a lower cost than the central TLP of the prior art which accommodates drilling from the TLP. Further, after drilling is complete, the semisubmersible vessels may be put into useful service elsewhere until needed for workover operations. Thus, the method of conducting well operations of the present invention permits reduced capital outlay, accelerated cash flow, increased rate of return on investment, and avoids the capital expenses associated with providing a full capability drilling rig dedicated for workover operations.

Figure 14:
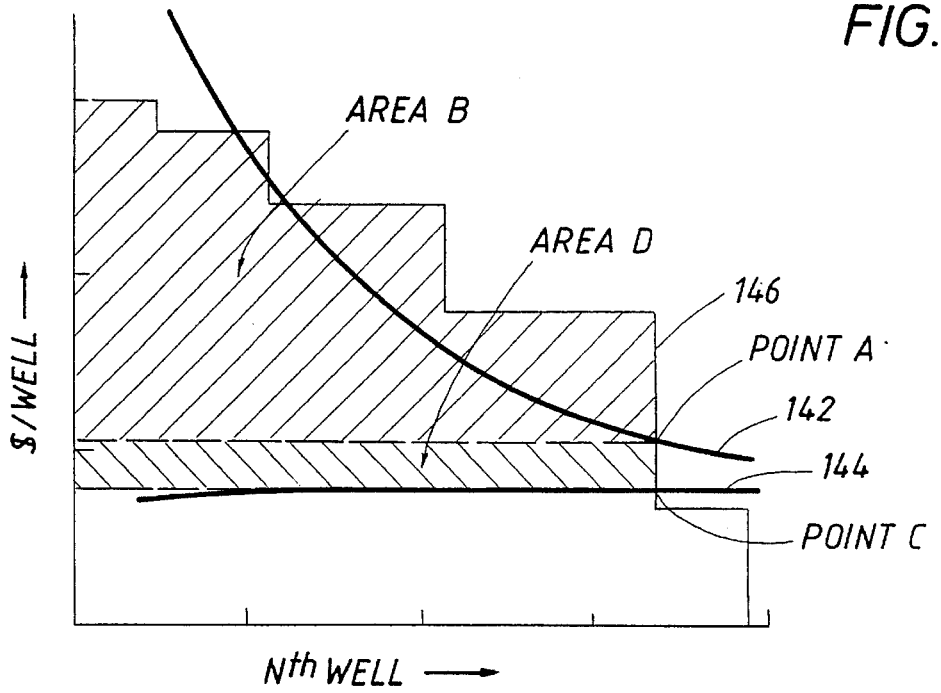
FIG. 14 is a generalized plot of economic curves of cost per well for each additional well for a hypothetical deepwater prospect "A"
Figure 15:
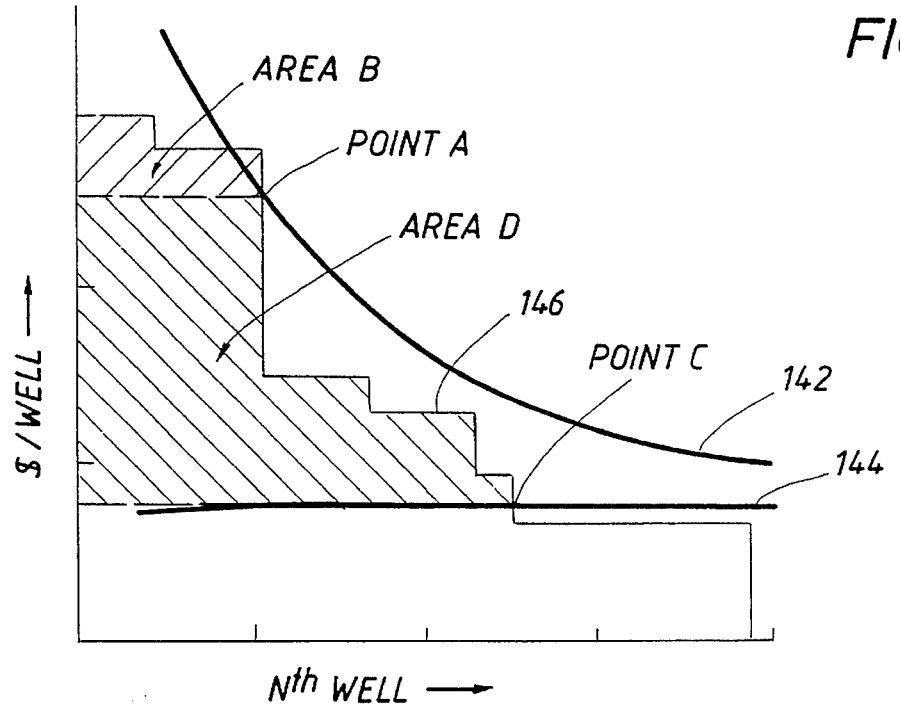
FIG. 15 is a generalized plot of economic curves of cost per well for each additional well for another hypothetical deepwater prospect, prospect "B".

FIGS. 14 and 15 further demonstrate the economic benefits which are facilitated by the practice of the present invention. FIG. 14 is a set of generalized curves for a hypothetical prospect "A". This illustration charts average development dollars per well for a conventional TLP development which includes a dedicated drilling rig (line 142) and a TLWJ development in accordance with the present invention (line 144) versus the number of wells "n" in the development. Also plotted is the present value income for the $n^{th}$ well which is expressed as line 146.

Present value income appears as a stair step function for which incremental contribution by additional wells decreases as the number of wells approaches the reservoir's capacity. Drilling completion costs per well are notionally included in the conventional TLP and the TLWJ development cost curves, but make little impact in the comparison since they are relatively constant regardless of whether a dedicated rig is provided on the TLP in accordance with the prior art or a semisubmersible vessel is used in the practice of the present invention.

Prospect A is a very promising prospect which can support a major, conventional, TLP deployment. The incremental development cost of the conventional TLP deployment, that is line 142, intersects the line defining the present value income per well (line 146), at point A which produces a net present value profit designated by area B. Stated otherwise, the profit is the total income for all developed wells minus the total development cost which is the cost per well at the point of intersection times the number of developed wells.

By contrast, the incremental development cost of a TLWJ in the practice of the present invention intersects the present value income per well line 146 at point C and provides additional income opportunity indicated by area D, for a total present value income per well of B plus D.

While FIG. 14 does illustrate a definite advantage, the practice with less promising prospects such as prospect "B" illustrated in FIG. 15, illustrates more profound benefits available through the practice of the present invention. Again, these generalized economic curves plot development costs and income potential in terms of dollars per well as a function of the next incremental development well. The incremental development costs of a major, dedicated rig TLP remain the same, as do the incremental development costs for a tension leg well jacket deployed in the practice of the present invention. However, the nature of the prospect has markedly affected the available present value income per well. Here, the economic development of a TLP with dedicated drilling facilities is determined by point A, which defines little profitability B. However, the incremental cost of development for additional wells in deployment of a TLWJ in the practice of the present invention, as established by point C, defines a vast incremental benefit as the present value income of area D. Note that this benefit cannot be economically exploited by a major TLP with dedicated drilling facilities. Thus, for the same prospect, the conventional technology provides a present value income B while the present invention provides a present value income of B plus D which, for marginal prospects, can be many times that otherwise available. This also demonstrates that the practice of the present invention can render economical the development of prospects which cannot be economically developed by the prior art.

Not only does the well operations method of the present invention facilitate using multiple, dispersed, minimal compliant platforms for the benefits illustrated above, it also reduces this risk of accident, as well as the potential magnitude thereof, by separating drilling and production operations. Further, moving well operations facilities to an auxiliary vessel allows use of minimal compliant platforms to support the production risers and this reduced capacity will significantly expand the number of suitable fabrications yards that are available. This will further impact cost as a result of increased competition for the construction contracts.

A number of variations have been disclosed for conducting well operations for compliant platforms using temporary facilities of an offshore vessel which then transfers production risers to the compliant platform. However, other modifications, changes and substitutions are intended in the foregoing disclosure. Further, in some instances, some features of the present invention will be employed without a corresponding use of other features described in these preferred embodiments. Accordingly, it is appropriate that the appended claims be construed broadly and in a manner consistent with the spirit and scope of the invention herein.

What is claimed is:

1. A method for conducting offshore well operations, comprising:

installing a compliant platform having a normal position in substantially vertical alignment with a well site;

positioning the offshore drilling vessel over a selected well site, comprising:

biasing the compliant platform out of substantially vertical alignment with the well site and securing this position with respect to the ocean floor; and substantially vertically aligning a drilling derrick of the offshore drilling vessel over the well site and securing this position with respect to the ocean floor and the well site situated thereon for well operations while continuing to restrain the relative position of the offshore drilling vessel with respect to the compliant platform by their respective positions as defined in relation to the ocean floor; and conducting well operations from the offshore drilling vessel through a riser.

2. A method for conducting offshore well operations, comprising:

installing a compliant platform at a first position with respect to an ocean floor which is in substantial vertical alignment with a well site;

positioning an offshore drilling vessel over a selected well site by driving the compliant platform out of its first position with respect to the ocean floor and substantially vertically aligning a drilling derrick of the offshore drilling vessel over the selected well site and independently securing the offshore drilling vessel in this position with respect to the ocean floor for well operations without direct, load transmitting structural connection therebetween;

conducting well operations from the offshore drilling vessel through a substantially vertical drilling riser; and transferring a production riser from the offshore drilling vessel to the compliant platform.

3. A method for conducting offshore well operations in accordance with claim 2 wherein biasing the compliant platform out of substantially vertical alignment with the well site comprises adjusting a plurality of catenary mooring lines which define the position of the compliant platform.

4. A method for conducting offshore well operations in accordance with claim 3 wherein positioning the offshore drilling vessel comprises adjusting a plurality of catenary mooring lines which define the position of the offshore drilling vessel with respect to the ocean floor.

5. A method for conducting offshore well operations in accordance with claim 3 wherein positioning the offshore drilling vessel in substantially vertical alignment with the well site comprises utilizing a dynamic positioning system including a set of thrusters.

6. A method for conducting offshore well operations, comprising:

restraining a compliant platform at a position defined in relation to the ocean floor which is out of its normal position substantially over a well pattern;

positioning an offshore drilling vessel at a position defined in relation to the ocean floor which is over a selected well site of the well pattern at a location at the surface of the water not accessible to the offshore drilling vessel with the compliant platform in its normal position; and conducting well operations through a substantially vertical riser while maintaining a space between the offshore drilling vessel and the compliant platform;

whereby the relative position of the offshore drilling vessel with respect to the compliant platform is defined indirectly as each is positioned in relation to its environment.

7. A method for conducting well operations in accordance with claim 6 wherein restraining a compliant platform at a position defined in relation to the ocean floor comprises adjusting a first set of catenary mooring lines and positioning the offshore drilling vessel in relation to the ocean floor comprises adjusting a second set of catenary mooring lines.

8. A method for conducting offshore well operations, comprising:

restraining a compliant platform out of its normal position substantially over a well pattern by adjusting a first lateral mooring system connecting the compliant platform to a first array of anchors secured to an ocean floor;

positioning an offshore drilling vessel over a selected well site of the well pattern at a location at the surface of the water not accessible to the offshore drilling vessel with the compliant platform in its normal position by adjusting a second lateral mooring system connecting the compliant platform to a second array of anchors on the ocean floor; and conducting well operations through a substantially vertical riser while maintaining a clearance between the offshore drilling vessel and the compliant platform through the respective first and second lateral mooring lines.

9. A method for conducting offshore well operations, comprising:

installing a compliant platform having a normal position in substantially vertical alignment with a well site;

positioning the offshore drilling vessel over a selected well site, comprising:

biasing the compliant platform out of substantially vertical alignment with the well site and securing this position with respect to the environment; and substantially vertically aligning a drilling derrick of the offshore drilling vessel over the well site and securing this position with respect to the environment and the well site on the ocean floor for well operations while continuing to restrain the relative position of the offshore drilling vessel with respect to the compliant platform by restraining their respective positions independently and without structural interconnection; and conducting well operations from the offshore drilling vessel through a riser.

10. A method for conducting offshore well operations in accordance with claim 9 wherein biasing the compliant platform out of substantially vertical alignment with the well site comprises adjusting a plurality catenary mooring lines which define the position of the compliant platform; and wherein positioning the offshore drilling vessel comprises adjusting a plurality of catenary mooring lines which define the position of the offshore drilling vessel with respect to the ocean floor independent of the restraint of the compliant platform.

11. A method for conducting offshore well operations, comprising:

restraining a compliant platform at a position defined in relation to the ocean floor which is out of its normal position substantially over a well pattern;

positioning an offshore drilling vessel at a position defined in relation to the ocean floor which is over a selected well site of the well pattern at a location at the surface of the water not accessible to the offshore drilling vessel with the compliant platform in its normal position; and conducting well operations through a substantially vertical riser while maintaining a space between the offshore drilling vessel and the compliant platform;

whereby the relative position of the offshore drilling vessel with respect to the compliant platform is defined indirectly as each is positioned in relation to its environment and without direct load transmitting interconnection therebetween.

12. A method for conducting well operations in accordance with claim 6 wherein restraining a compliant platform at a position defined in relation to the ocean floor comprises adjusting a first set of catenary mooring lines and positioning the offshore drilling vessel in relation to the ocean floor comprises adjusting a second set of catenary mooring lines.

* * * * *